US006482057B1

(12) United States Patent
Schoell

(10) Patent No.: US 6,482,057 B1
(45) Date of Patent: Nov. 19, 2002

(54) TRIMMABLE MARINE DRIVE APPARATUS

(76) Inventor: Harry L. Schoell, 601 NE. 26th Ct., Pompano Beach, FL (US) 33046

( * ) Notice: Subject to any disclaimer, the term of this patent is extended or adjusted under 35 U.S.C. 154(b) by 0 days.

(21) Appl. No.: 09/690,636

(22) Filed: Oct. 17, 2000

Related U.S. Application Data

(60) Provisional application No. 60/160,252, filed on Oct. 19, 1999.

(51) Int. Cl.[7] ..... B63H 20/08

(52) U.S. Cl. ..... 440/53; 440/57; 440/63

(58) Field of Search ..... 440/53, 57, 61, 440/63, 65, 54

(56) References Cited

U.S. PATENT DOCUMENTS

| | | | | | |
|---|---|---|---|---|---|
| 176,541 | A | * | 4/1876 | McKaig et al. | 440/59 |
| 931,159 | A | * | 8/1909 | Stribling | 440/62 |
| 1,028,333 | A | * | 6/1912 | Desenberg et al. | 440/65 |
| 1,473,832 | A | * | 11/1923 | Park, Jr. | 440/65 |
| 1,745,354 | A | * | 2/1930 | Collins | 440/53 |
| 2,265,079 | A | * | 12/1941 | Mettair | 440/63 |
| 2,415,183 | A | * | 2/1947 | Law | 440/62 |
| RE24,451 | E | * | 4/1958 | Daniels | 440/53 |
| 2,856,883 | A | * | 10/1958 | Baker | 440/56 |
| 2,956,536 | A | * | 10/1960 | Kilvington | 440/59 |
| 3,469,558 | A | * | 9/1969 | Puretic | 440/53 |
| 3,752,111 | A | * | 8/1973 | Meynier, Jr. | 440/56 |
| 3,933,116 | A | * | 1/1976 | Adams et al. | 440/57 |
| 3,976,027 | A | * | 8/1976 | Jones, Sr. | 440/61 |
| 4,089,289 | A | * | 5/1978 | Sauder | 440/61 |
| 4,334,872 | A | * | 6/1982 | Gaston | 440/61 |
| 4,645,463 | A | | 2/1987 | Arneson | |
| 4,726,796 | A | | 2/1988 | Rivetter, Jr. et al. | |
| 4,728,308 | A | | 3/1988 | Weismann | |
| 4,775,342 | A | | 10/1988 | Connor et al. | |
| 4,976,638 | A | | 12/1990 | Grinde | |
| 4,981,452 | A | | 1/1991 | Grinde | |
| 5,066,255 | A | | 11/1991 | Sand | |
| 5,100,350 | A | * | 3/1992 | Buzzi | 440/82 |
| 5,326,294 | A | | 7/1994 | Shoell | |
| 5,376,028 | A | * | 12/1994 | Koyanagi | 440/41 |
| 5,791,954 | A | * | 8/1998 | Johnson, Jr. | 440/112 |
| 5,863,230 | A | * | 1/1999 | Morrison | 440/61 |
| 5,931,710 | A | * | 8/1999 | Johnson, Sr. | 440/55 |

* cited by examiner

*Primary Examiner*—S. Joseph Morano
*Assistant Examiner*—Ajay Vasudeva
(74) *Attorney, Agent, or Firm*—Brooks & Kushman P.C.

(57) ABSTRACT

A drive apparatus (12) for a boat having a planing hull (14) including a notch (24). An engine (30) and a transmission (32) are mounted within the hull. A propeller shaft (38) is connected to the transmission with a universal joint (34) and extends rearwardly therefrom into the notch. The propeller shaft passes through a shaft support (56), and a propeller (46) is affixed to the propeller shaft behind the shaft support. The shaft support depends from a strut (58), which is mounted on the underside of a pivot arm (50). A trim drive (62) is mounted within the hull and above the notch and the pivot arm. A linearly extendable trim drive shaft (64) extends between the trim drive and the pivot arm and, when the trim drive is actuated, pivots the pivot arm, and thus the propeller, selectively upwardly and downwardly to adjust trim for maximum drive efficiency under various boat load distribution, water surface and wind conditions.

26 Claims, 5 Drawing Sheets

TRIMMABLE MARINE DRIVE APPARATUS

CROSS-REFERENCE TO RELATED APPLICATION

This application is for an invention disclosed in the manner provided by the first paragraph of 35 U.S.C. §112 in Provisional Application No. 60/160,252, filed Oct. 19, 1999.

TECHNICAL FIELD

This invention relates generally to marine drive apparatuses and more specifically to such apparatuses having means for vertically adjusting the operating position of a stern-drive propeller.

BACKGROUND ART

Various apparatuses for driving one or more stern-drive boat propellers are known in the art. Probably the most common system includes an engine and a transmission located inside a boat hull. Power is communicated to a propeller via a propeller shaft connected between the transmission and the propeller and passing through a notch transom via a watertight fitting. Also known are inboard-outboard devices that have inboard engines coupled to steerable out-drives. Some of the latter systems have transmissions mounted within the hull, and some have transmissions mounted within the out-drive.

A planing boat has specific power application requirements related to the fact that, at planing speed, a component of the force of the water acting on the hull causes it to lift so that only a rear portion of the boat is in contact with the water. A benefit of reduced hull-water contact is reduced drag, which translates into increased boat speed at a given power setting. Drag can be further lessened by maintaining a minimum angle between respective hull and water surfaces.

The angle the hull lower surface makes with the water surface at planing speed is related to the location of the propeller. The force of a propeller located well below the bottom of the boat generates a relatively large moment that tends to lift the bow of the boat and to reduce the effectiveness of the planing characteristics of the hull.

The angle the hull lower surface makes with the water surface at planing speed is also related to the angle between the axis of rotation of the propeller and the surface of the water. The greater the angle is between the propeller shaft and the water surface, the greater will be a moment generated by the force of the propeller that tends to depress the bow. Since the plane of rotation of each propeller is at right angles to its associated propeller shaft, an angle between the propeller shaft and the water surface is reflected in an equal angle between the propeller plane and the vertical. This places downwardly moving propeller blades at a somewhat greater pitch than upwardly moving blades relative to water flow, which reduces propeller efficiency and promotes vibration.

An improvement in drive efficiency would be effected if the drive components could be disposed so that drive force is aligned with the bottom surface of the hull. Even this would not provide an ideal solution, however, because such factors as changing boat load distribution, water surface conditions and wind velocity contribute to unstable trim symmetry.

DISCLOSURE OF INVENTION

An object of the present invention is to provide an improved marine drive apparatus for a boat wherein the operating position of a drive propeller is vertically adjustable.

Another object is to provide a marine drive apparatus that is capable of directing its thrust substantially along the plane of the lower surface of a planing boat hull.

Yet another object is to provide a marine drive apparatus having a decreased angle between the rotation axis of the propeller and the plane of the lower surface of the planing boat hull without increasing the number of friction-generating drive displacement elements.

Still another object is to provide a marine drive apparatus wherein a substantial portion thereof is above the water when the boat is running at planing speed.

Another object is to provide a marine drive apparatus, the drive thrust of which is received by an inboard universal joint between a propeller shaft and a transmission output member, rather than by a through-hull fitting in a transom.

A feature of the present invention is a pivot arm assembly that supports a propeller shaft and responds to mechanical input from a trim drive to adjust the vertical position of the propeller shaft.

Another feature is mounting the trimmable marine drive apparatus in a notch disposed at the stern of a boat so that the direction of propeller thrust is in the plane of the hull lower surface when the boat is running at planing speed.

Still another feature is that the propeller shaft is maintained at a small angle relative to the water surface and that the plane of the propeller is thus maintained at a small angle relative to the vertical.

Yet another feature is that most of the trimmable marine drive apparatus is located above the surface of the water when the boat is running at planing speed.

Another feature is a fin depending from the shaft support to increase stability and to reduce the likelihood of striking submerged objects with the propeller, rudder or shaft support when the boat is in motion.

An advantage of the present invention is that the capability of adjusting the vertical position of the propeller provides means for maximizing trim efficiency and boat performance.

Another advantage is that maintaining the propeller shaft at a small angle relative to the water surface and the axis of rotation of the propeller generally in line with the lower surface of the hull reduces bow-lifting and bow-depressing moments, thus reducing hull drag and wind influences on the hull.

Still another advantage is that maintaining the plane of the propeller nearly vertical maximizes propeller efficiency and minimizes propeller vibration caused by pitch differences between ascending and descending propeller blades.

Yet another advantage is gained by the notch mounting position and the pivot arm assembly design in that having most of the trimmable marine drive apparatus above the water surface when the boat is running at planing speed reduces drive apparatus drag, thus increasing boat performance.

Another advantage gained by the notch mounting position and the pivot arm assembly design is that a minimum number of friction-generating and drag-generating drive displacement components are required to position the axis of rotation of the propeller proximate the water surface when the boat is running at planing speed.

Other advantages gained by the notch mounting position and the pivot arm assembly design include an increased stabilization and a decreased likelihood of striking submerged objects with the propeller, rudder or shaft support when the boat is in motion.

In realizing the aforementioned and other objects, features and advantages, the trimmable marine drive apparatus of the present invention includes, for use with a power boat having a planing hull with a notch and having an inboard drive assembly, which includes an engine and a transmission operably connected thereto, a propeller shaft having a driven end pivotally connected to and rotatably driven by the transmission, a driving end opposite the driven end, and a central longitudinal axis of rotation.

A propeller is secured to the driving end of the propeller shaft. The propeller is preferably a surfacing-type propeller designed to run efficiently while only partially submerged. The driven end of the propeller shaft is pivotally connected to the transmission with a universal joint. The universal joint compensates for angular adjustments to the propeller shaft and receives the drive thrust generated by the propeller.

The drive apparatus further includes a pivot arm assembly having a pivot arm including a forward end pivotally attached to the hull within the notch for movement about a transverse axis. The pivot arm also has a rear end rearwardly spaced from the forward end, a shaft support rotatably supporting the propeller shaft proximate its driving end, and a strut connecting the shaft support to the pivot arm.

The shaft support includes an upper portion and a lower portion connected thereto. Each portion is configured to provide in cooperation a generally longitudinal passage through the shaft support. A sheave-shaped pivot bearing is rotatably disposed within the longitudinal passage, and each of the upper and lower portions of the shaft support are further configured to conform to the external contours of the pivot bearing. This limits motion thereof to angular displacement in a vertical plane.

A bearing sleeve is positioned within a portion of the longitudinal passage of the shaft support to rotatably support the propeller shaft. The bearing sleeve resides within a diametrically aligned aperture in the pivot bearing. The longitudinal passage is vertically elongated to accommodate angular displacements, in a vertical plane, of the bearing sleeve and the propeller shaft when the trim drive is operated. A fin depends from the underside of the shaft support.

A trim drive is mounted within the hull and has an extendable member depending through the hull and pivotally connected to the pivot arm to raise and lower the rear end thereof. Vertical adjustments of the pivot arm by the trim drive are communicated to the propeller via the strut, the shaft support and the propeller shaft to maximize boat performance under various operating conditions. The trim drive is hydraulically operated and is capable of angularly positioning the propeller shaft within a range of at least three degrees above and below an angle that vertically positions the axis of rotation of the propeller shaft at the propeller in the same plane as that of the planing hull at the notch transom.

BRIEF DESCRIPTION OF DRAWINGS

A more complete appreciation of the invention and many of the attendant features and advantages thereof may be readily obtained by reference to the following detailed description when considered with the accompanying drawings in which like reference characters indicate corresponding parts in all views, wherein.

BEST MODE FOR CARRYING OUT THE INVENTION

Figure 1:
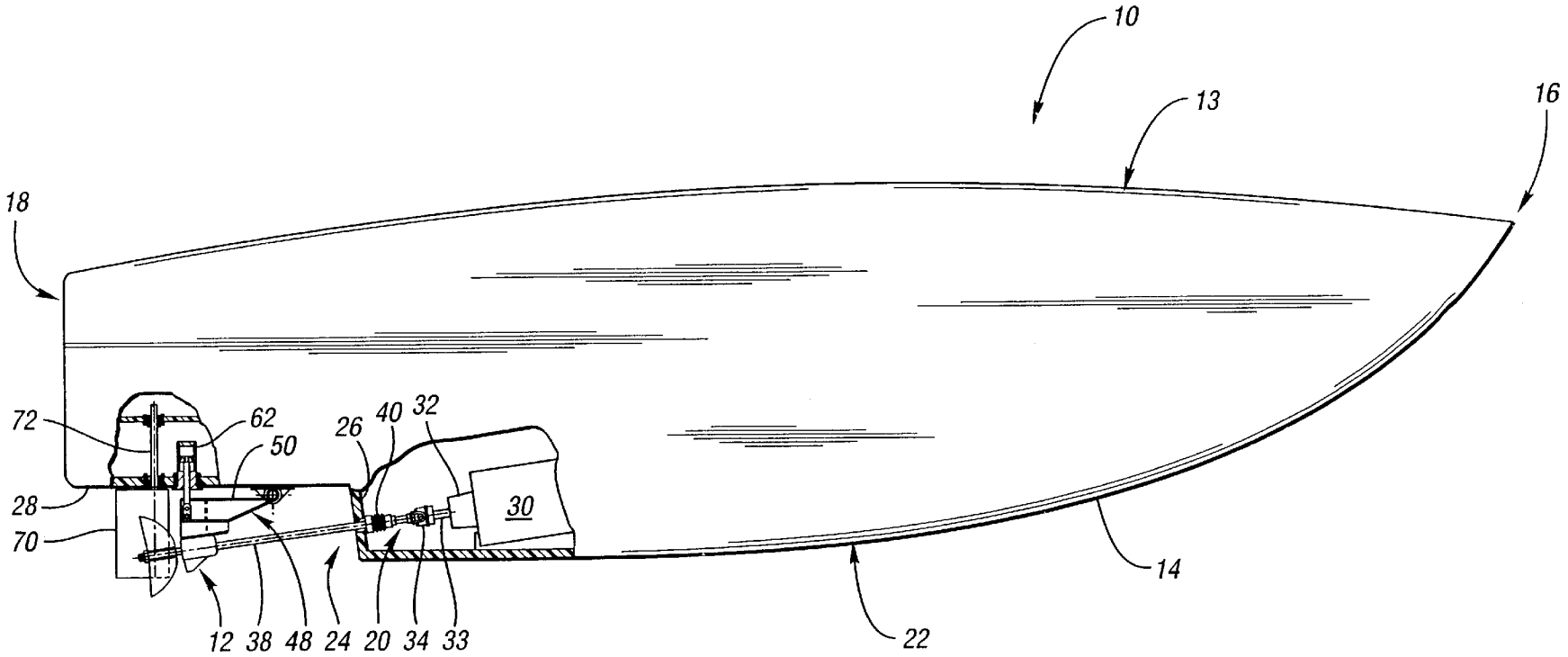
FIG. 1 is a side view, partially broken away and partially in section and showing the present invention.
Figure 2:
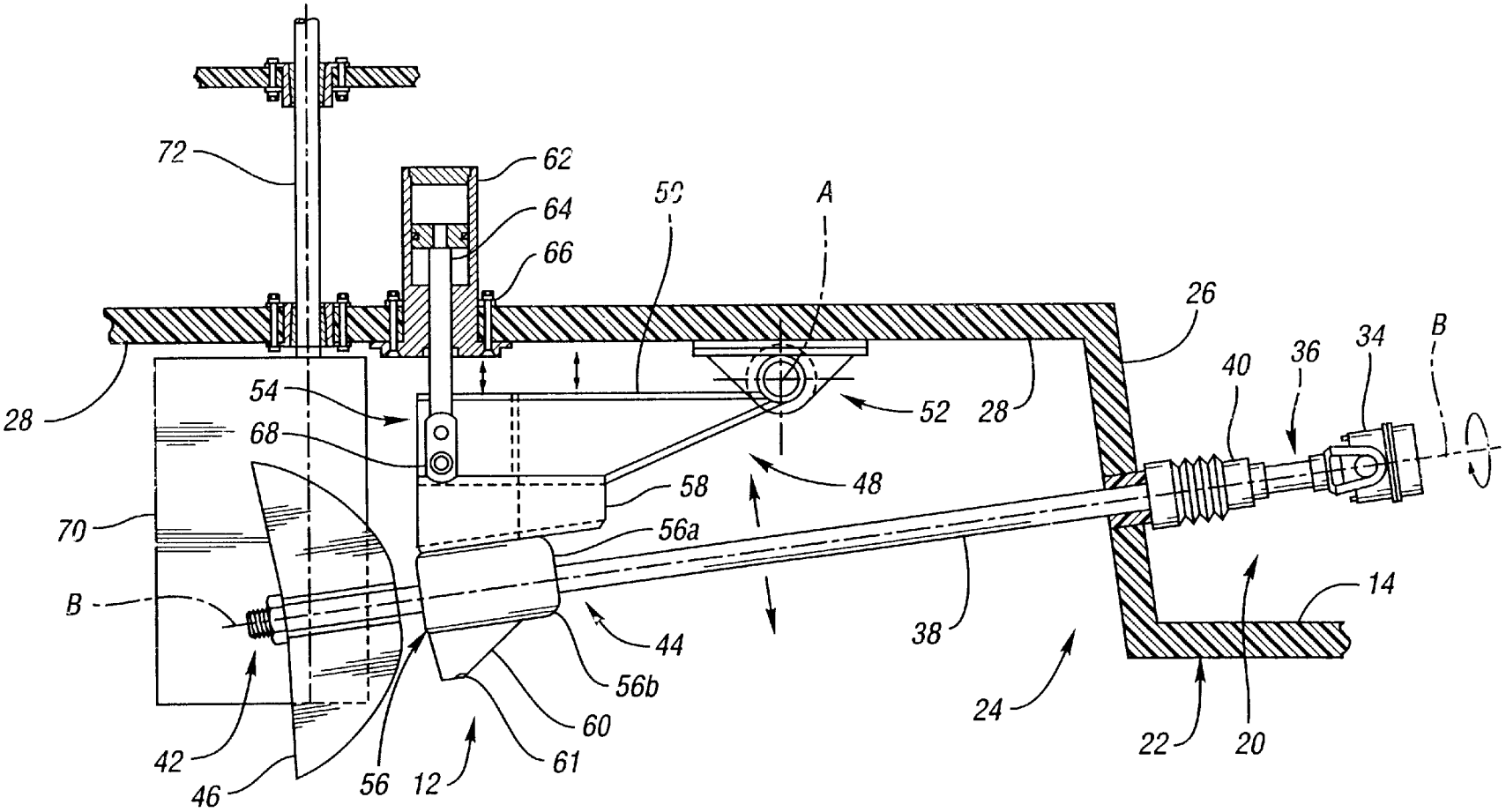
FIG. 2 is a detailed side view, partially broken away and partially in section, of a major portion of the present invention.

FIG. 1 of the drawing is a side view of a boat, generally indicated by reference numeral 10, having a trimmable marine drive apparatus, generally indicated by reference numeral 12, of the present invention. The illustration of the boat 10 is meant to be generally representative of a power boat that might have the present drive apparatus installed, but it is not intended to depict a boat of any more specific configuration. The boat 10 has a hull, generally indicated by reference numeral 14, and a deck, generally indicated by reference numeral 13, forming an outer shell having a bow, generally indicated by reference numeral 16, and a stern, generally indicated by reference numeral 18. As shown in FIGS. 1 and 2, the hull 14 encloses an internal cavity, generally indicated by reference numeral 20, and has a hull lower surface, generally indicated by reference numeral 22 that engages and planes upon a water surface when the boat 10 is at planing speed. The hull lower surface 22 forms a notch, generally indicated by reference numeral 24, at the stern 18 of the boat 10. The notch 24 is defined by a notch transom 26 extending generally vertically from the hull lower surface 22, forward of the stern 18, and by an overhead mounting surface 28 extending generally longitudinally between the notch transom 26 and the stern 18.

As shown in FIG. 1, an engine 30 and a transmission 32 are mounted within the cavity 20, ahead of the notch transom 26. An output member 33 of the transmission 32 is pivotally connected through a universal joint 34 to a driven end, generally indicated by reference numeral 36 (FIG. 2), of a propeller shaft 38, which passes through the notch transom 26 via a water-tight transom fitting 40. The propeller shaft 38 also has a driving end, generally indicated by reference numeral 42, opposite its driven end 36. A propeller 46 is mounted on the driving end 42 of the propeller shaft 38 to rotate therewith. A propeller having a number of configurations may be used, but a surface-piercing, or surfacing-type, propeller is preferred. Such a propeller is designed to run efficiently, to run at a high speed, to develop a minimum load, and to run with a substantial portion thereof above a water surface. The universal joint 34 compensates for angular adjustments to the propeller shaft 38 and receives the drive thrust generated by the propeller 46 rather than having the thrust received by a through-hull fitting.

A pivot arm assembly, shown in FIGS. 1 and 2, is generally indicated by reference numeral 48. The pivot arm assembly 48 is preferably, but not necessarily, disposed within the notch 24; and when the boat 10 is running at planing speed, the assembly 48 is substantially above the surface of the water, thus minimizing the amount of appendage drag. The pivot arm assembly 48 includes a pivot arm, generally indicated by reference numeral 50, a shaft support, generally indicated by reference numeral 56, and a strut 58. The pivot arm 50 has a forward end, generally indicated by reference numeral 52, and a rear end, generally indicated by reference numeral 54. The forward end 52 is pivotally attached to the hull 14 within the notch and intermediate the notch transom 26 and the trim drive 62 to pivot about a transverse axis A (shown in FIGS. 3 and 4 and shown end-on in FIGS. 1 and 2).

The propeller shaft 38 passes through the shaft support 56, which rotatably supports the driving end 42 thereof. The strut 58 is connected to the underside of the pivot arm 50 and to the upper side of the shaft support 56 to position and support the latter. The shaft support 56 preferably has a fin 60 depending from its lower surface to increase stability and to reduce the likelihood of striking submerged objects with the propeller, rudder or shaft support when the boat is in motion. An aperture, generally indicated by reference numeral 61, is defined within the lower, leading edge of the fin 60 and communicates with the longitudinal passage 80 proximate a pivot bearing 78 (FIGS. 5B and 7B).

As shown in FIGS. 1 and 2, a trim drive 62 is mounted within the cavity 20. The trim drive 62 is preferably hydraulically operated and has a linearly extendable member, or shaft, 64 that depends through the overhead mounting surface 28, via a water-tight overhead mounting surface fitting 66. The trim drive shaft 64 is pivotally connected to the pivot arm 50 proximate the rear end 54 thereof and selectively raises and lowers the pivot arm 50 about the lateral axis A when the trim drive 62 is actuated. The trim drive 62 is capable of angularly positioning the propeller shaft 38 within a range of at least three degrees above and below an angle that vertically positions the axis of rotation B of the propeller shaft 38 at the propeller 46 in the same plane as that of the planing hull 14 at the notch 24. As shown in FIGS. 1 and 2, a steerable rudder 70 is rotatably supported by a rudder post 72 that extends downwardly through the overhead mounting surface 28 proximate the stern 18. It should be understood that the rudder 70 shown is representative of one of a number of possible configurations. For example, in a boat having one propeller, a rudder might be disposed behind and in line with it. Two rudders might be used, each laterally offset to a different side of the propeller. In a boat having two propellers and associated trim drives, a rudder might be laterally offset to the left of one and to the right of the other. Each propeller might have a pair of rudders each of which is laterally offset to a different side. Each propeller might have a rudder disposed behind and in line with it.

The nearly vertical rotational plane of the propeller 46 maximizes propeller efficiency and minimizes propeller vibration caused by pitch differences between ascending and descending propeller blades. The nearly vertical rotational plane of the propeller 46 and its proximity to the surface of the water when the boat is running at speed also minimize moments tending to lift or depress the bow 16, thus minimizing hull drag and adverse wind effects.

While the views provided in FIGS. 1 and 2 show only a single engine 30, transmission 32, pivot arm assembly 48, drive shaft 38 and propeller 46, it should be understood that a pair or more of each would commonly be used in a high-performance boat.

Figure 3:
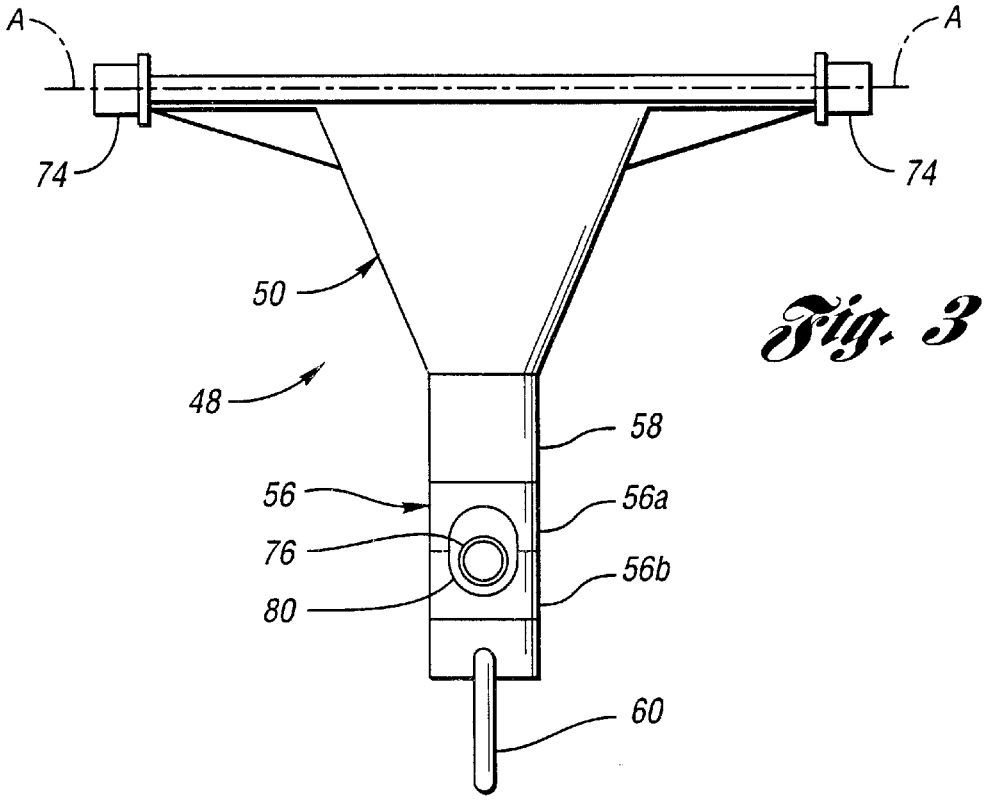
FIG. 3 is a front view of a pivot arm assembly shown in FIG. 2.
Figure 4:
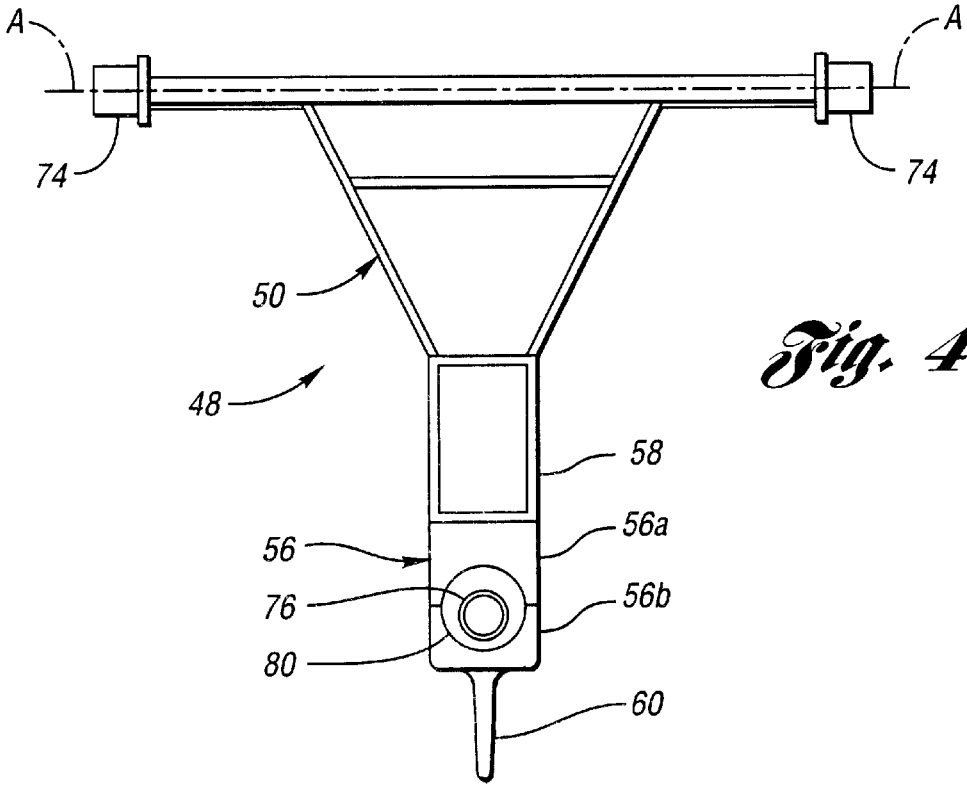
FIG. 4 is a rear view of the pivot arm assembly shown in FIG. 3.

FIG. 3 shows the pivot arm assembly 48 as viewed facing the stern 18, and FIG. 4 shows the pivot arm assembly 48 as viewed facing the bow 16. Extending laterally outwardly from each side of, and along the transverse pivot axis A (shown in FIGS. 3 and 4 and shown end-on in FIGS. 1 and 2) of, the pivot arm 50 is a journal 74. Each journal 74 is rotatably mounted on the overhead mounting surface 28, aft of the intersection of the notch transom 26 and the overhead mounting surface 28, to pivot about the transverse axis A. A bearing sleeve 76 is pivotally mounted within the shaft support 56, as is shown in detail in FIGS. 5B and 7B.

Figure 5A:
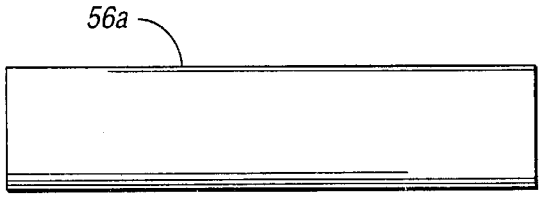
FIGS. 5A, 5B and 5C together represent a side exploded view of a shaft support, a pivot bearing and a bearing sleeve of the pivot arm assembly shown in FIGS. 3 and 4.
Figure 5B:
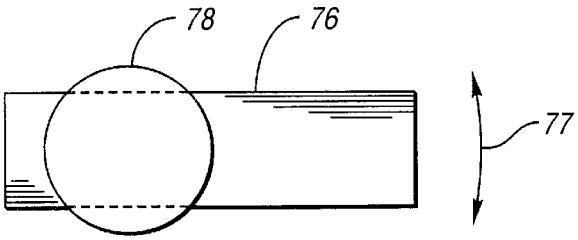
Figure 5C:
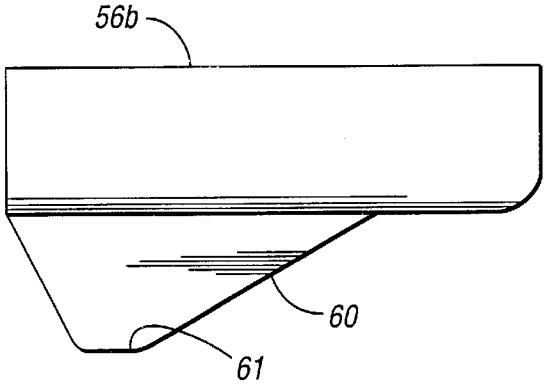
Figure 6A:
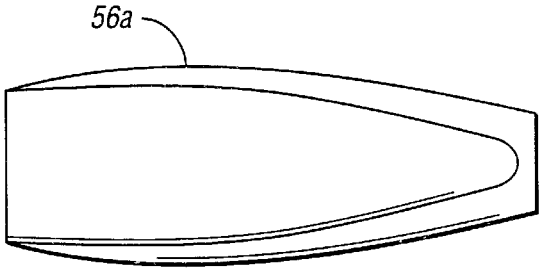
FIGS. 6A and 6B are respective views showing the external configurations of the top and bottom portions of the shaft support shown in FIGS. 5A and 5C.
Figure 6B:
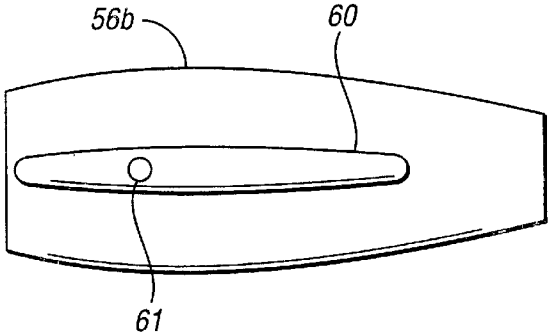
Figure 7A:
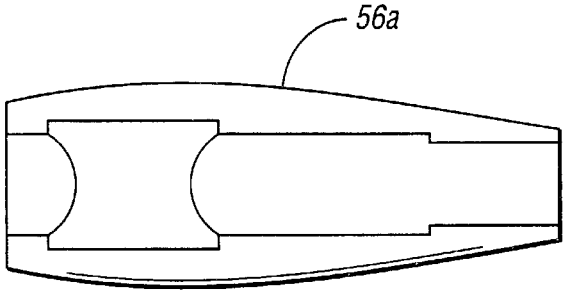
FIGS. 7A and 7C are respective views showing the internal configurations of the top and bottom portions of the shaft support shown in FIGS. 5A and 5C.
Figure 7B:
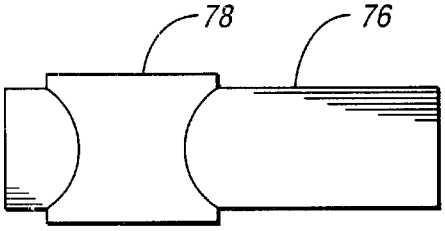
FIG. 7B is a top view of the propeller shaft support sleeve and a pivot bearing shown in FIG. 5B.
Figure 7C:
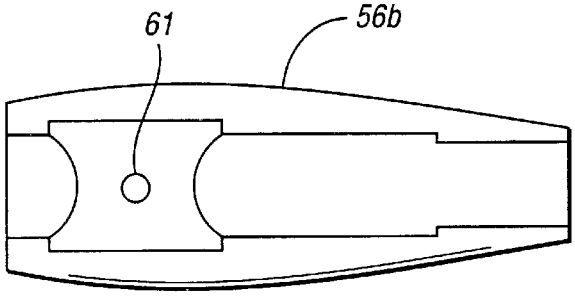

FIGS. 5A, 6A and 7A respectively represent side, top and interior views of the upper portion 56*a* of the shaft support 56. FIGS. 5C, 6B and 7C respectively represent side, bottom and interior views of the lower portion 56*b* of the shaft support 56. The shaft support 56 is preferably formed of the two separate portions 56*a* and 56*b* to facilitate inspection and replacement of the bearing sleeve 76 and the pivot bearing 78. FIGS. 5C and 6C show a fin 60 depending from the lower portion 56*b* of the shaft support 56. FIGS. 5B and 7B respectively represent a side view and a top view of a bearing sleeve 76 of the pivot arm assembly 48 shown in FIGS. 3 and 4. Likewise, a side view and a top view of a sheave-shaped pivot bearing 78 are shown. The bearing sleeve 76 rotatably supports the propeller shaft 38, which passes therethrough.

A portion of the bearing sleeve 76 resides within a diametrically aligned aperture in the pivot bearing 78 and is affixed thereto with a fastening device such as a setscrew or a pin. As shown in FIGS. 7A and 7C, the upper and lower portions (56*a* and 56*b* respectively) of the shaft support 56 are internally formed to create a generally longitudinal passage 80 through the shaft support 56. A portion of the passage conforms to the configuration of the pivot bearing 78. The pivot bearing 78 is thus radially and axially imprisoned within the shaft support 56 but is free to rotate. The longitudinal passage is vertically elongated to allow the bearing sleeve 76 to pivot in a vertical plane with the pivot bearing 78, as indicated by the arcuate arrow 77 in FIG. 5B. The vertical elongation of the passage 80 is sufficient to accommodate bearing sleeve and propeller shaft angle changes attending changes in the angular disposition of the pivot arm assembly 48 whenever the trim drive 62 is operated.

Figure 8:
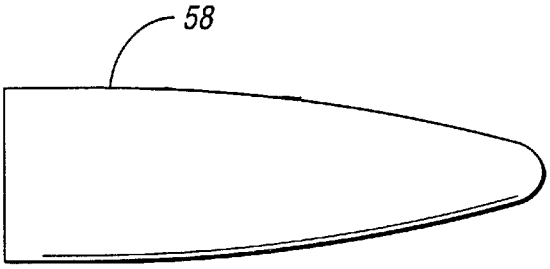
FIG. 8 is a bottom view of a strut of the pivot arm assembly shown in FIGS. 3 and 4.

FIG. 8 is a bottom view of the strut of the pivot arm assembly shown in FIGS. 3 and 4. As indicated in FIG. 6A, its shape conforms to the configuration of the flat area atop the upper portion 6A of the shaft support 56.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A drive apparatus mounted in relation to a mounting surface of a water craft, the drive apparatus comprising:

a propeller shaft having a driven end, a driving end, and a central longitudinal axis of rotation, the driven end of the propellor shaft connected to a drive assembly;

a pivot arm assembly having a forward end pivotally attached to the mounting surface for angular movement about a transverse axis and having a rear end, the pivot arm assembly supporting the propellor shaft proximate its driving end, the mounting surface being located on a lower underside surface of the hull that engages and planes upon a water surface when the water craft is at planing speed; and a trim drive affixed to the mounting surface and having an extendable member pivotally connected to the pivot arm assembly to raise and lower the rear end thereof and thereby a propeller associated with the propellor shaft.

2. The drive apparatus as defined by claim 1, wherein the trim drive is hydraulically operated.

3. The drive apparatus as defined by claim 1, wherein the forward end of the pivot arm assembly is pivotally attached to the mounting surface above a length of the propeller shaft that is intermediate its driven end and its driving end.

4. The drive apparatus as defined by claim 3, wherein the drive assembly includes an engine and a transmission operably connected thereto.

5. The drive apparatus as defined by claim 4, wherein the driven end of the propeller shaft is pivotally connected to the transmission through a universal joint, the universal joint compensating for vertical adjustments to the propeller shaft and receiving the drive thrust generated by the propeller.

6. The drive apparatus as defined by claim 5, wherein the pivot arm assembly includes a pivot arm, the forward end of which forms the forward end of the pivot arm assembly that is pivotally attached to the mounting surface, the pivot arm assembly further including a shaft support rotatably supporting the propeller shaft, and a strut connecting the shaft support to the pivot arm, vertical adjustments of the pivot arm by the trim drive being communicated to the propeller via the strut.

7. The drive apparatus as defined by claim 5, wherein the pivot arm assembly includes a pivot arm the forward end of which forms the forward end of the pivot arm assembly that is pivotally attached to the mounting surface, the pivot arm assembly further including a shaft support rotatably supporting the propeller shaft, and a strut connecting the shaft support to the pivot arm, vertical adjustments of the pivot arm by the trim drive being communicated to the propeller via the strut, the shaft support and the propeller shaft to maximize thereby craft performance under various operating conditions.

8. The drive apparatus as defined by claim 7, wherein the shaft support comprises:

an upper portion;

a lower portion connected to the upper portion, each portion being configured to provide in cooperation a generally longitudinal passage through the shaft support;

a sheave-shaped pivot bearing rotatably disposed within the longitudinal passage, each of the upper and lower portions of the shaft support being further configured to conform to the external contours of the pivot bearing to limit motion thereof to angular displacement in a vertical plane; and a bearing sleeve disposed within a portion of the longitudinal passage of the shaft support to rotatably support the propeller shaft, the bearing sleeve residing within a diametrically disposed aperture in the pivot bearing, the longitudinal passage being vertically elongated to accommodate angular displacements, in a vertical plane, of the bearing sleeve and the propeller shaft when the trim drive is operated.

9. The drive apparatus as defined by claim 8, further including a propeller, wherein the propeller is a surfacing-type propeller designed to run efficiently while only partially submerged.

10. The drive apparatus as defined by claim 8, further including a fin depending from the underside of the shaft support to improve lateral stability.

11. The drive apparatus as defined by claim 10, wherein the fin has an aperture therein to admit ambient water for conduction into the longitudinal passage of the shaft support proximate the pivot bearing.

12. The drive apparatus as defined by claim 7, wherein the shaft support comprises:

an upper portion;

a lower portion connected to the upper portion, each portion being configured to provide in cooperation a generally longitudinal passage through the shaft support;

a sheave-shaped pivot bearing rotatably disposed within the longitudinal passage, each of the upper and lower portions of the shaft support being further configured to conform to the external contours of the pivot bearing to limit motion thereof to angular displacement in a vertical plane; and a bearing sleeve disposed within a portion of the longitudinal passage of the shaft support to rotatably support the propeller shaft, the bearing sleeve residing within a diametrically disposed aperture in the pivot bearing, the longitudinal passage being vertically elongated to accommodate angular displacements, in a vertical plane, of the bearing sleeve and the propeller shaft when the trim drive is operated.

13. The drive apparatus as defined by claim 12, further including a propellor, wherein the propeller is a surfacing propeller designed to run efficiently while only partially submerged.

14. The drive apparatus as defined by claim 12, further including a fin depending from the underside of the shaft support to improve lateral stability.

15. The drive apparatus as defined by claim 14, wherein the fin has an aperture therein to admit ambient water for conduction into the longitudinal passage of the shaft support proximate the pivot bearing.

16. The drive apparatus as defined by claim 1, wherein the trim drive hydraulically operated.

17. A drive apparatus mounted beneath an overhead mounting surface of a power boat having a drive assembly and a planing hull including a bow, a stern and a hull lower surface, the drive apparatus comprising:

at least one propellor shaft, each propeller shaft having a driven end, a driving end, and a central longitudinal axis of rotation, the driven end of the propellor shaft being connected to the drive assembly, the drive assembly being mounted within the hull, the hull having defined therein at least one notch extending from the stern toward the bow, the at least one notch having a notch transom extending upwardly from the hull lower surface and having an overhead portion forming the overhead mounting surface and extending generally longitudinally from the notch transom toward the stern;

at least one pivot arm assembly, each pivot arm assembly having a forward end pivotally attached to the overhead structure for angular movement about a transverse axis and having a rear end, each pivot arm assembly supporting the at least one propeller shaft proximate its driving end, the mounting surface being located on a lower underside surface of the hull that engages and planes upon a water surface when the water craft is at planing speed; and at least one trim drive, each trim drive being mounted within the hull and having an extendable member depending through the overhead structure and being pivotally connected to the at least one pivot arm assembly to raise and lower the rear end thereof and thereby a propellor associated with the at least one propeller shaft.

18. The drive apparatus as defined by claim 17, wherein the forward end of the at least one pivot arm assembly is pivotally attached to the overhead structure intermediate the notch transom and the stern.

19. The drive apparatus as defined by claim 18, wherein the at one drive assembly includes an engine and a transmission operably connected thereto.

20. The drive apparatus as defined by claim 19, wherein the driven end of each propeller shaft is pivotally connected to the transmission through a universal joint disposed within the hull between the transmission and the notch transom, each universal joint compensating for vertical adjustments to the propeller shaft and receiving the drive thrust generated by the propeller.

21. The drive apparatus as defined by claim 20, wherein each pivot arm assembly includes a pivot arm, the forward end of which forms the forward end of the pivot arm assembly that is pivotally attached to the overhead structure, each pivot arm assembly further including a shaft support rotatably supporting the propeller shaft, and a strut connecting the shaft support to the pivot arm, vertical adjustments of the pivot arm by the trim drive being communicated to the propeller via the strut, the shaft support and the propeller shaft to maximize thereby craft performance under various operating conditions.

22. The drive apparatus as defined by claim 21, wherein each shaft support comprises:

an upper portion;

a lower portion connected to the upper portion, each portion being configured to provide in cooperation a generally longitudinal passage through the shaft support;

a sheave-shaped pivot bearing rotatably disposed within the longitudinal passage, each of the upper and lower portions of the shaft support being further configured to conform to the external contours of the pivot bearing to limit motion thereof to angular displacement in a vertical plane; and a bearing sleeve disposed within a portion of the longitudinal passage of the shaft support to rotatably support the propeller shaft, the bearing sleeve residing within a diametrically disposed aperture in the pivot bearing, the longitudinal passage being vertically elongated to accommodate angular displacements, in a vertical plane, of the bearing sleeve and the propeller shaft when the trim drive is operated.

23. The drive apparatus as defined by claim 22, further including at least one propellor, wherein each propeller is a surfacing propeller designed to run efficiently while only partially submerged.

24. The drive apparatus as defined by claim 22, further including a fin depending from the underside of each shaft support to improve lateral stability.

25. The drive apparatus as defined by claim 24, wherein each fin has an aperture therein to admit ambient water for conduction into the longitudinal passage of the shaft support proximate the pivot bearing.

26. The drive apparatus as defined by claim 11, wherein each trim drive is hydraulically operated.

* * * * *